US005353780A

United States Patent [19]

Carella

[11] Patent Number: 5,353,780

[45] Date of Patent: Oct. 11, 1994

[54] ARCHERY TRAINING DEVICE

[76] Inventor: Richard F. Carella, 35572 Strathcona Dr., Clinton Township, Mich. 48035

[21] Appl. No.: 125,925

[22] Filed: Sep. 23, 1993

Related U.S. Application Data

[63] Continuation-in-part of Ser. No. 913,862, Jul. 15, 1992, Pat. No. 5,277,170.

[51] Int. Cl.[5] ..... F41B 5/00; A63B 21/00

[52] U.S. Cl. ..... 124/86; 124/80; 124/23.1

[58] Field of Search ..... 124/86, 90, 23.1, 1, 124/88; 482/121, 124, 126

[56] References Cited

U.S. PATENT DOCUMENTS

| | | | |
|---|---|---|---|
| 4,887,584 | 12/1989 | Carella . | |
| 4,909,232 | 3/1990 | Carella | 124/86 |
| 5,052,365 | 10/1991 | Carella . | |
| 5,163,413 | 11/1992 | Carella | 124/90 |
| 5,277,170 | 1/1994 | Carella | 124/23.1 |

*Primary Examiner*—Randolph A. Reese
*Assistant Examiner*—Anthony Knight
*Attorney, Agent, or Firm*—Remy J. VanOphem

[57] ABSTRACT

An archery training device for teaching an archer proper muscular control, muscle force and body positioning before, during, and after release of an arrow for promoting accurate shooting of the arrow with a bow. The archery training device promotes a push-pull balance between the archer's string arm elbow and bow hand throughout the shot while also providing feedback of this balance when shooting arrows. The archery training device includes a string arm connector which is securable to the string arm elbow and a bowstring connector that is secured to the bowstring. An inelastic cord-like force carrying member extends between the string arm connector and the bowstring connection which creates a predetermined slack in the force carrying member when the archer is in the full draw position. Upon full release of the bowstring by the archer's fingers, the cord-like force carrying member becomes taut and instantaneously transfers the tensional forces to the upper body of the archer. The muscles associated with the archer's upper body are thereby required to remain taut throughout the draw and release of the bowstring to maintain a proper push-pull balance throughout the shot, while also restraining the anchor hand, bow hand, string arm, and shoulders from movement that would adversely affect shooting accuracy.

11 Claims, 4 Drawing Sheets

ARCHERY TRAINING DEVICE

CROSS-REFERENCE TO RELATED APPLICATION

This application is a continuation in part of copending parent application Ser. No. 07/913,862, filed Jul. 15, 1992, now U.S. Pat. No. 5,277,170.

BACKGROUND OF THE INVENTION

1. Field of the Invention

This invention relates to an archery training device for teaching an archer proper muscular control, muscle force and body positioning upon bowstring release for accurate shooting of a bow and arrow. More specifically, the present invention promotes a balance between the archer's push-pull and the bow force while also providing feedback of this balance to teach an archer proper muscular control.

2. Description of the Prior Art

An observer of an archer shooting a bow and arrow occasionally witnesses a flinching or collapsing of the archer's upper body during the process of releasing the bowstring. Obviously, such body movement or imbalance contributes to inconsistent and inaccurate shooting of an arrow with the bow. The importance of an archer practicing every day to improve his skills, and thereby minimize the tendency for collapse or imbalance, has led to a need for training devices. For example, an archery training device was disclosed by Applicant in U.S. Pat. No. 4,887,584. However, U.S. Pat. No. 4,887,584 does not teach an archery training device that simultaneously allows an archer to experience the sudden reaction forces which the archer's body must resist upon release of a bowstring since the exercise device does not teach releasing the bowstring to shoot arrows in that a substantially inelastic force carrying member is employed. The inelastic force carrying member is suitable for isometric exercises, but artificially limits the archer's draw to the length of the inelastic force carrying member as well as unrealistically simulates the instantaneous forces which are experienced by the archer's body as a result of releasing a bowstring.

In contrast, U.S. Pat. No. 5,052,365, also in the name of applicant, discloses an archery training device specifically adapted for use with a bow, with or without an arrow. However, using this archery training device with an arrow adversely affects the arrow's performance, as well as the archer's muscles' reaction because the total push-pull force upon bowstring release is gradually applied to the body muscles as a result of the elastomeric force carrying member thereby making it unsuitable as an exercise device for most practical purposes. U.S. Pat. No. 5,052,365 discusses in detail that the cause of this collapse is attributable to the archer having relaxed his or her upper back muscles during the initial stage of the shot so that the anchor hand (the hand used to draw the bowstring), bow hand, string arm elbow, or shoulders begin to move before the string fingers are completely free of the bowstring. This "reflex muscle relaxation" is an involuntary response, and, therefore, can only be shortened, but not eliminated entirely.

Ideally, for maximum stability while shooting an arrow, certain points of the archer's upper body frame should lie within a plane termed the "rigid frame plane". As can be seen in FIGS. 4 and 5, these points are the string arm or rear elbow joint 24 of the string arm 22, the anchor hand 34, the string or rear shoulder 23, the front shoulder 25 and the contact point of the bow hand 15 with the bow 14. The string arm elbow 24, the rear shoulder 23 and the contact point of the bow hand 15 with the bow 14 define the corners of a scalene triangle that establishes the rigid frame plane $\alpha$. An archer properly maintaining the rigid frame plane $\alpha$ during the reflex muscle relax time will reduce movement of the string or anchor hand 34, bow hand 15, string arm elbow 24, and shoulders 23 and 25 in a manner which will improve shooting accuracy.

FIGS. 1 through 5 shows the string arm elbow joint 24, the anchor hand 34 superimposed on the bow hand 15, and the string shoulder 23, indicated by points A, B and C, respectively, lying in the rigid frame plane $\alpha$. Simultaneously, the anchor hand 34 and bow hand 15 lie in the bow plane $\beta$, which determines the lateral trajectory of the arrow. FIG. 2 illustrates a common defect in the stance of an archer 12 in which the string arm elbow 24 is outside the rigid frame plane $\alpha$ by some distance X. As a result, during the period in which the bowstring is being released, the anchor hand 34 ("B") is also forced out of the bow plane $\beta$, causing a significant error in the arrow's trajectory, as illustrated by FIG. 3.

In that the consequences of failing to attain the rigid frame plane $\alpha$ arise during the period between the beginning of the release of the bowstring and the time at which the string fingers are clear of the bowstring, this period is of primary importance in ascertaining the total effect of the rigid frame plane $\alpha$. This period, in which the upper back muscles relax before the string fingers are free of the bowstring, has been termed the "reflex muscle relax time". The reflex muscle relax time begins when the string fingers start to open and ends when they are free of the forward pull exerted by the bowstring.

In general, the shorter the reflex muscle relax time, the less opportunity there will be for the collapse or otherwise adverse movement of the archer's bow hand 15, anchor hand 34, string arm elbow 24, and shoulders 23 and 25 outside of the rigid frame plane $\alpha$. Consequently, a shorter reflex muscle relax time will enable the archer 12 to shoot more consistently and accurately even if the rigid frame plane $\alpha$ is not entirely achieved at the beginning of the shot. It also follows that proper muscular force and positioning of the anchor hand 34, string arm elbow 24, shoulders 23 and 25 and bow hand 15 within the rigid frame plane a during the reflex muscle relax time will also reduce the previously noted collapsing and imbalance of the archer's upper body, and thus promote more consistent and accurate shooting.

With reference again to FIGS. 4 and 5, the stance of the archer 12 at the start of the reflex muscle relax time is indicated at "D". As a result of failing to perfectly achieve the rigid frame plane $\alpha$ in conjunction with the reflex muscle relax time, the stance at the end of release, i.e. the end of the reflex muscle relax time, is altered as indicated at "E". Where no reflex muscle relax time occurs, the arrow's trajectory is indicated by a "zero relax line" 56. However, as a consequence of the inherent tendency to have reflex muscle relaxation and an imperfect rigid frame plane $\alpha$, the trajectory of the arrow is generally indicated by a "body relax line" 52.

U.S. Pat. No. 5,052,365, supra, provides an archery training device having an elastic member which is attachable to the archer's string elbow and the bowstring to induce a gradual increase in tension between the string elbow and the bow hand due to the elastomeric force carrying member after release of the bowstring. The effect is to train the archer's muscles to remain taut throughout the shot to thereby minimize reflex muscle relaxation and thereby minimize the adverse effect of the reflex muscle relax time. The archery training device provides the archer feedback regarding his or her upper body position and reflex muscle relax time after the bowstring release. This feedback is based on either an imbalance of forces exerted by upper back muscles which causes adverse movement of the anchor hand, bow hand, string arm elbow, and shoulders or an incorrect positioning of the bow hand, string arm elbow and shoulders. When the archer is properly positioned in the full draw position, the elastic member is positioned against his or her neck. However, if improper shifting of the upper body occurs during the shot due to a force imbalance, the elastic member shifts away from the side of the neck during release of the bowstring, a signal to the archer that he or she is not maintaining proper upper body positioning. If an arrow were to be shot at the time, this shifting would have an adverse effect on shooting accuracy. However, the device is not suitable for providing real time feedback when shooting an arrow because the elastic member is attached directly to the bowstring and the tensional force is applied gradually by the elastic member on the bow and, therefore, does not properly simulate the actual real time shooting of an arrow.

U.S. Pat. No. 4,887,584, supra, discloses a similar device with a first embodiment disclosing an inelastic force carrying member extended between the string arm elbow and the bowstring, while another embodiment includes an elastic member between the force carrying member and the bow handle to simulate the bow draw force in the archer's stance without the use of an actual bow. As with U.S. Pat. No. 5,052,365, these devices are intended for isometric exercise to train the archer's muscles to remain taut throughout the shot, which serves to minimize the effect of the reflex muscle relax time. However, the use of an inelastic force carrying member artificially limits the archer's draw to the length of the force carrying member and does not permit the archer to experience the actual bowstring release which instantaneously unloads the body muscles tending to affect push-pull force generated by the bow. Even in the embodiment where an elastic member is attached between the force carrying member and the bow, the elasticity of the member only permits a gradual build-up of the maximum forces to which the archer's body must react. Accordingly, none of the above devices are suitable for simulating the actual shooting of an arrow in order to allow the archer's body to build up resistance to reflex muscle relax time due to the real time instantaneous force built up during an actual bow shot and the sudden release thereof using an arrow.

In addition to the reflex muscle relax time, applicant has determined that another critical aspect of shooting an arrow involves the push-pull balance between the bow hand 15 and the string arm elbow 24. More specifically, it is imperative that the pull force of the anchor hand 34 and the push force of the bow hand 15, which define a force line on the rigid frame plane $\alpha$, are balanced to assure stability and accuracy of the shot. Contrary to what one might think, the push and pull of the draw are independent of each other. As illustrated in FIG. 6, an archer's push-pull balance is defined with respect to the archer's spine 13. The front half push of the bowstring draw exists between the spine 13 and the bow hand 15, while the rear half pull of the draw exists between the spine 13 and the string elbow 24. The push-pull forces are designated to be either "dynamic" or "static." A dynamic force means contracting muscles that adapt to remain equal to the opposing bow force during bowstring release. A static force means contracting muscles that are less than the opposing bow force during bowstring release. The above is summarized in a pamphlet distributed by Applicant under the title "The Technical Side of Archery Form and the Formaster Training Device." R. F. Carella (1992), p. 5.

When balanced, the push-pull effect acts along the previously-noted body relax line 52 throughout the release cycle (unless zero reflex muscle relax time could be achieved then, the push-pull effect would act along the zero relax line 56 shown in FIGS. 4 and 5). Each half opposes the bow force with equal dynamic force during the release cycle. However, if each half of the push-pull does not have the same dynamic muscle force when the bowstring is released, the arrow's trajectory will follow a "force relax line" 54, which differs from the body relax line 52, as illustrated in FIGS. 7 and 8. FIG. 7 shows the effect of the pull being static, resulting in a collapse between the spine 13 and the string arm elbow 24 during the release of the bowstring, corresponding to the archer's aim being deflected to the left. FIG. 8 shows the effect of the push being static, resulting in a collapse between the spine 13 and the bow hand 15 during the release of the bowstring, corresponding to the archer's aim being shot to the right. In each case, the force relax line 54 deviates from the body relax line 52, thereby significantly affecting the arrow's trajectory, which compounds the effect of the reflex muscle relax time that establishes the body relax line 52.

It would be desirable to provide a device which can be used as an exercise device and which can be used with an arrow, thereby enabling the use of the device during actual shooting of an arrow to improve the ability of the archer to maintain his or her push-pull balance in addition to sustaining the rigid frame plane while minimizing the reflex muscle relax time. U.S. Pat. No. 4,887,584, supra, was directed only to improving the stance for the rigid frame plane and muscle strengthening, and furthermore did not allow the use of an arrow. The archery training device taught by U.S. Pat. No. 5,052,365 was not suitable for actually shooting an arrow because the elastic member would impair the arrow's performance. Further, the elastic member did not exactly simulate the shooting of an arrow since the tensional force was applied gradually due to the elasticity of the member, resulting in the associated muscles of the body not experiencing a real time shooting of an arrow.

Accordingly, what is needed is an archery training device which aids in maintaining the push-pull balance of an archer's stance while also reducing the effects of the reflex muscle relax time and promoting proper positioning of the bow hand 15, string arm elbow 24, and shoulders 23 and 25 of the archer 12 within the rigid frame plane $\alpha$ when he or she is drawing and releasing the bowstring. In addition, what is needed is such an archery training device that will achieve the above aspects while also permitting the archer to shoot an arrow to allow the body to experience an actual shot to serve as a distinct form of feedback as to his or her push-pull balance and stance.

SUMMARY OF THE INVENTION

The archery training device of the present invention is directed to teaching an archer proper upper body muscular control, push-pull balance, and positioning while shooting an arrow with a bow.

In addition, the archery training device promotes proper positioning and muscle force of the archer's shoulders, string arm elbow, anchor hand, bow arm and bow hand along the rigid frame plane such that collapse of the string arm and bow arm is minimized during and after release of the arrow. Importantly, the proper muscle force sought is the push-pull balance between the archer's bow hand and string arm elbow to avoid collapse of the front or rear half of the archer's stance during the release cycle. Such a collapse would otherwise cause shooting errors due to the archer's body being moved left-right or up-down relative to the intended target. Moreover, the archery training device actually promotes the proper stance, push-pull balance and reflex muscle relax time.

In the preferred embodiment, the archery training device includes a string arm connector which has a pair of loops, one being an upper loop securable to the upper arm of the archer's string arm proximate the elbow, and the other being a lower loop which is securable to the forearm of the archer's string arm proximate the elbow. Together, the loops cooperate by straddling the string arm elbow to prevent shifting of the string arm connector about the elbow.

Attached to the string arm connector is an interconnecting or force carrying member having a cord-like construction. The force carrying member is also secured to the bowstring of the bow utilizing a convenient slip knot. The inelastic nature of the force carrying member specifically provides sufficient extension between the string arm connector and the bowstring connection when the bowstring is fully drawn so as not to interfere with the draw of the bowstring. In the preferred embodiment, the force carrying member has sufficient slack so as to allow the complete release of the bowstring when actually shooting an arrow. In use, the force carrying member is completely slack between the string arm connector and the bowstring when the archer expands the draw with his or her fingers to obtain a full draw position. Upon complete release of the bowstring the force carrying member is completely extended and taut between the string arm elbow and the bowstring, and the entire force of the bow is instantaneously experienced by the archer's upper body forcing the muscles of the upper back, shoulders, string arm, bow arm and bow hand to remain taut to reduce movement of the shoulders, string arm elbow and bow arm from the rigid frame plane through the shot. Training the muscles to remain taut also assists in preventing the collapse of the string arm and bow arm during and after release of the arrow.

In addition, the tensile forces acting upon the string arm elbow and the bow hand through the release of the bowstring and instantaneous build up of all of the forces of the shot on the body maintains the dynamic push-pull balance between the bow hand and the string arm elbow. As a result, the upper back muscles are forced to continue to push and pull throughout the shot, thus training the upper back muscles to shorten reflex muscle relax time by inhibiting collapse of the upper back muscles, shoulders and string arm elbow. Contrary to all of the prior art, the tensile forces imposed by the archery training device of the present invention are immediately built up and remain constant, thereby requiring muscle tautness to resist the bow force once the string is released and throughout the shot, from the initial stage of the draw until the arrow has left the bow and the archer is free to relax from the full draw position. These constant tensile forces increase the draw force when at full draw, having very little effect for compound shooters and a greater effect for recurve shooters. The muscle force throughout the shot requires that the push-pull balance on the bow also be maintained even as the string arm fingers are releasing the bowstring and associated arrow.

A particularly important feature of the present invention is that the archery training device provides the archer feedback pertaining to his or her push-pull balance, upper body position and reflex muscle relax time before, during and after the bowstring release. The feedback is based on an imbalance of forces exerted by the upper back muscles which causes adverse movement of the bow hand, string arm elbow, and shoulders or an incorrect positioning of the bow hand, string arm elbow and shoulders. The feedback can be experienced by an archer because the force carrying member will move up or down or away from the side of the neck as a result of a force imbalance or improper upper body positioning.

According to a preferred aspect of this invention, by using the archery training device, the archer's upper back develops a "muscle memory" of the shortened reflex muscle relax time which enables him to shoot this shortened reflex without the training device. Continuous feedback by the force carrying member within the rigid frame plane develops muscle memory allowing for duplication of this correct position without the training device during subsequent shooting.

In addition, a significant advantage of the present invention is that the tensile forces exerted by the interconnecting member continue throughout the draw and release of the bowstring, requiring the archer to maintain the rigid frame plane and push-pull balance before, during and after the shot. The tensile forces teach the correct muscle force for each half of the archer to balance the push-pull, while also shortening the reflex muscle relax time. In the preferred embodiment, these tensile forces can be adjusted to suit the particular archer and type of bow by adjusting the length of the cord-like interconnecting member.

Finally, an added advantage to the archery training device is that it is particularly adapted to be used while shooting an arrow. The force carrying member is extended between the string arm elbow and the bowstring so as not to interfere with the bowstring and the arrow. Moreover, no forces are imposed directly upon the bow that would affect arrow performance prior to complete release of the arrow from the bowstring. Permitting use of the device while shooting an arrow provides the archer with immediate and positive feedback as to his or her reflex muscle relax time, rigid frame plane and push-pull balance.

Accordingly, it is an object of the present invention to provide an archery training device which is capable of promoting proper positioning of an archer's anchor hand, bow hand, string arm elbow and shoulders so that they are coplanar.

It is a further object of the invention that such an archery training device be capable of promoting proper muscular control in the archer's upper back throughout the shot, from the time the bowstring is drawn until the arrow has cleared the bow.

It is still a further object of the invention that such an archery training device provide feedback to the archer, promoting reduced movement of the archer's anchor hand, bow hand, string arm elbow and shoulders during and after the release of the bowstring.

It is another object of the invention that the archery training device force the archer to maintain proper push-pull balance throughout the shot to prevent collapse of the archer's bow hand, string arm and shoulder after release of the bowstring.

It is yet another object of the invention that the archery training device be adapted for use while actually shooting an arrow.

It is still another object of the invention that such an archery training device with repeated use will develop muscle memory in the archer such that the archer will duplicate proper posture, muscle control and muscle force when not using the training device during actual shooting.

Other objects and advantages of this invention will be more apparent after a reading of the following detailed description taken in conjunction with the drawings provided.

DETAILED DESCRIPTION OF THE PREFERRED EMBODIMENT

Figure 1:
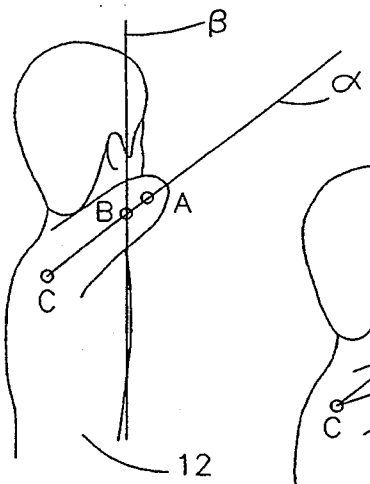
FIG. 1 is a rear view of an archer showing the archer's rear shoulder, string arm elbow and anchor hand positioned in the rigid frame plane.
Figure 2:
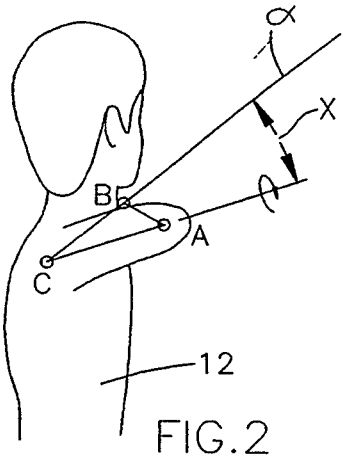
FIG. 2 is a rear view of an archer showing the archer's string arm elbow lying outside the rigid frame plane.
Figure 3:
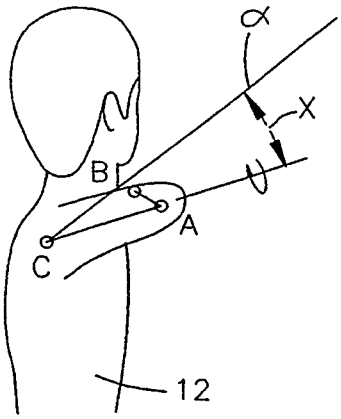
FIG. 3 is a rear view of the archer showing the result of the archer's stance of FIG. 2 as a consequence of the reflex muscle relax time during the release of the bowstring.
Figure 8:
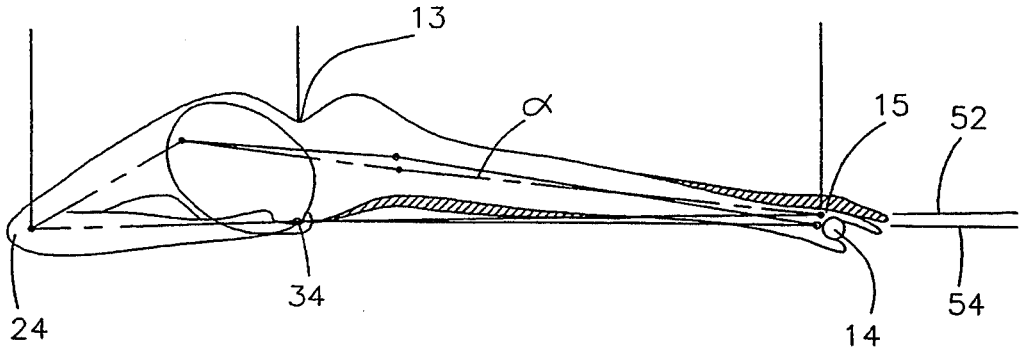
FIG. 8 is a top view of an archer showing the effect of an improper push-pull balance in which the front half of the archer is providing only a static force opposing the bow force.
Figure 9:
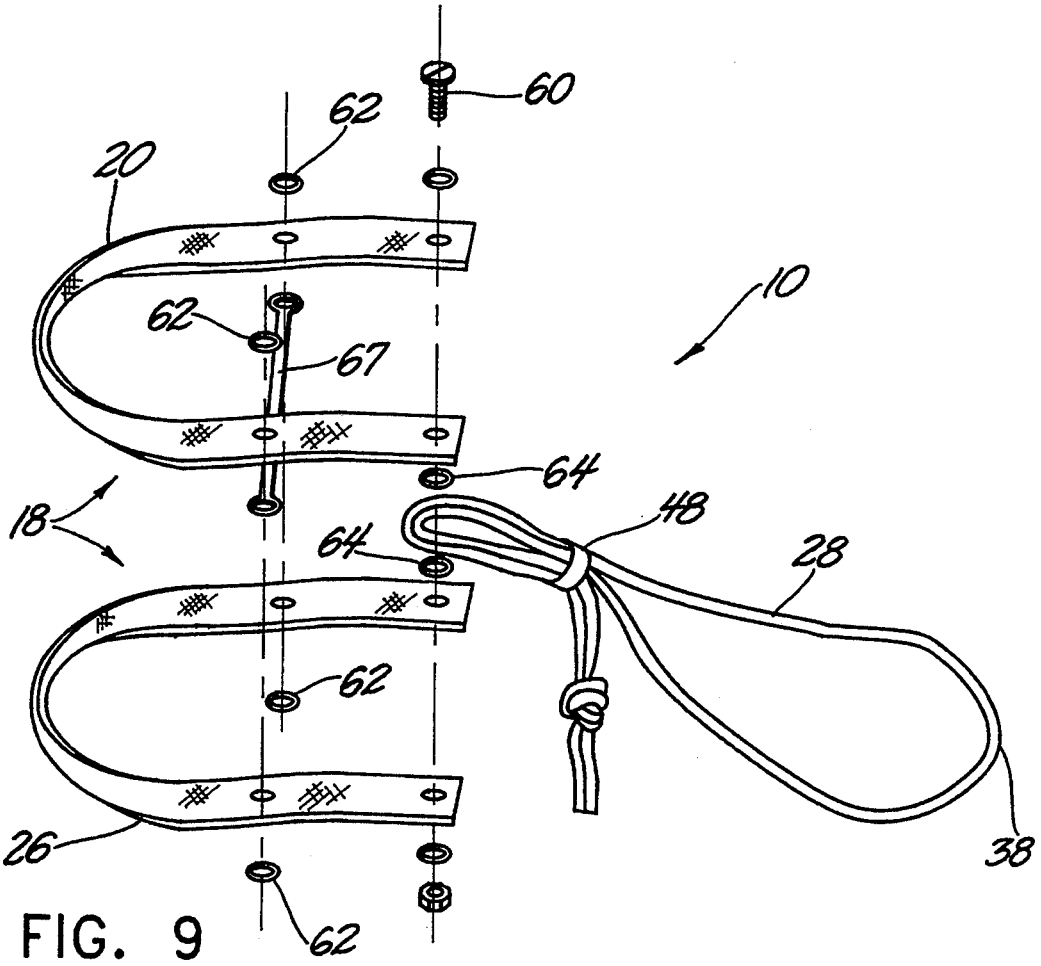
FIG. 9 is an exploded view of an archery training device showing the preferred construction in accordance with a preferred embodiment of the present invention.
Figure 10:
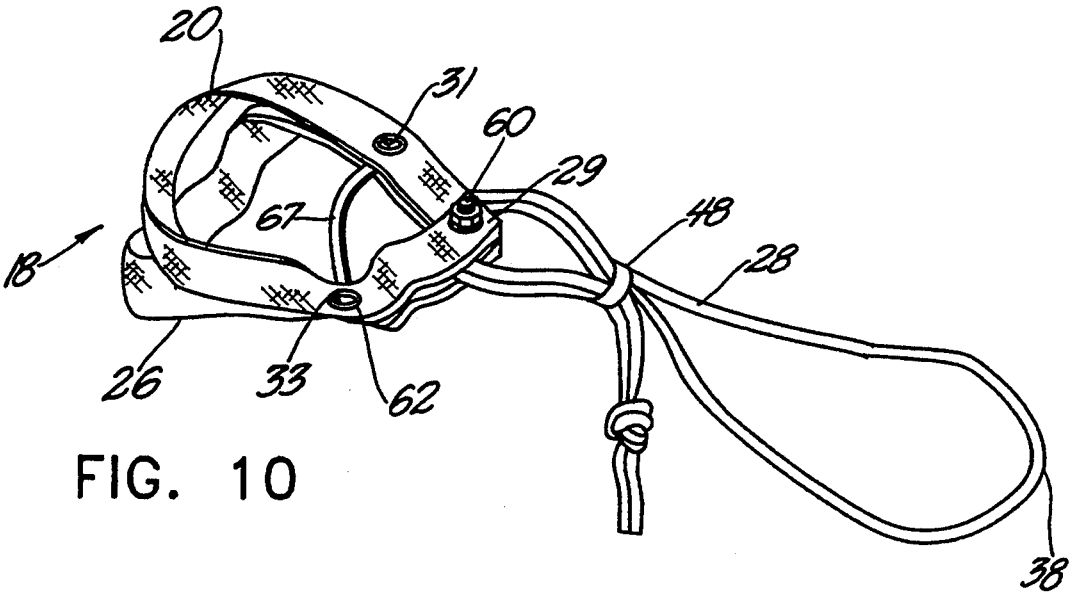
FIG. 10 is a perspective view of the archery training device shown in FIG. 9.

With reference to FIGS. 9 and 10, there is shown an archery training device 10 according to a preferred embodiment of the present invention. Throughout the following description of the archery training device 10, continued reference will be made to concepts embodied in FIGS. 1 through 8. As described previously, FIGS. 1 through 3 are rear views of an archer 12 illustrating the rigid frame plane $\alpha$ and the coplanar relationship of points on the archer's string arm elbow A, the anchor hand superimposed on the bow hand (together identified as point B), and the string shoulder C. Seen as profile D in FIGS. 4 and 5, for best accuracy and consistency in shooting the anchor point (34) B, the string arm elbow (24) A, the contact point of the bow hand (15) to the bow (14) B, and the bow (front) and string (rear) shoulder joints 25 and 23 should be coplanar on the rigid frame plane $\alpha$ in the full draw position. When all such points are positioned so that they are coplanar, forces created by the bowstring 16 being drawn do not move the bow hand 15 or anchor hand 34 as much from the intended trajectory (the zero relax line 56) of the arrow during the reflex muscle relax time.

Figure 4:
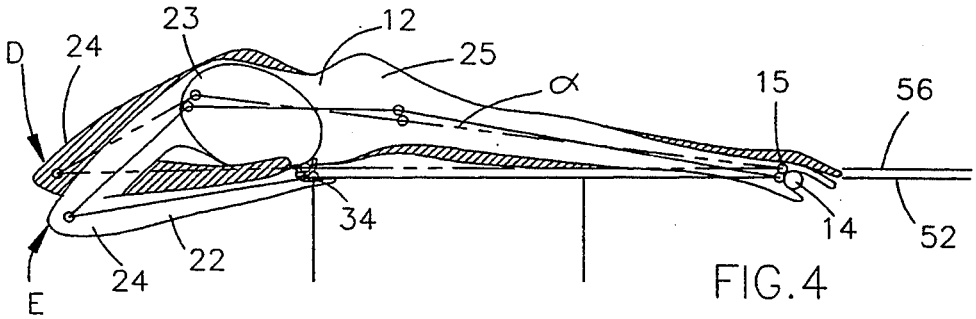
FIG. 4 is a top view of an archer in which the effects of the reflex muscle relax time are illustrated relative to the zero relax line.
Figure 5:
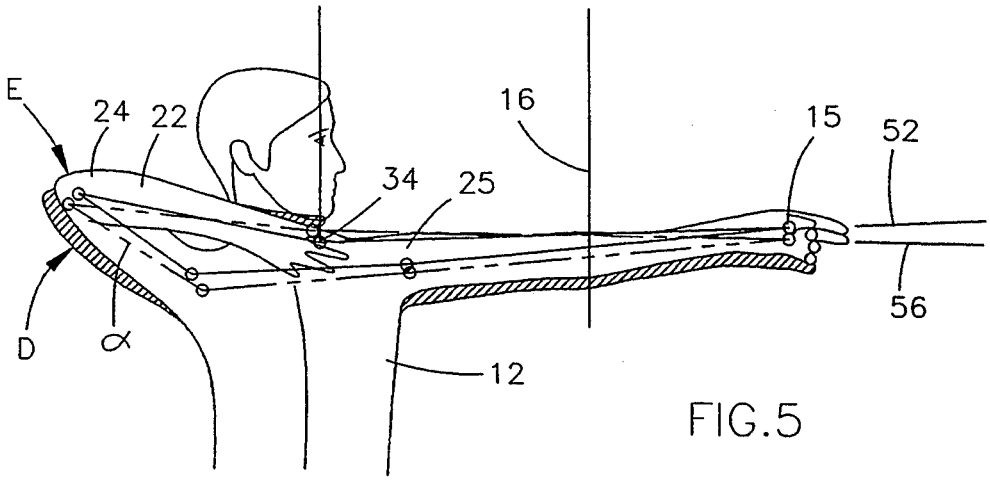
FIG. 5 is a side view of the archer of FIG. 4.

As seen by profile E in FIGS. 4 and 5, if not aligned in a coplanar relationship before release of the bowstring 16, the bow hand 15, the string arm elbow 24 and the anchor hand 34 have a tendency to move during the reflex muscle relax time, thus causing the archer's aim to deviate from the intended trajectory (the zero relax line 56), as evidenced by the body relax line 52, adversely affecting shooting accuracy. Even a small amount of movement caused by a resultant force due to the string arm elbow 24 being below the rigid frame plane $\alpha$ will tend to move the anchor hand 34 during the reflex muscle relax time, thus causing inaccuracy in shooting.

Figure 6:
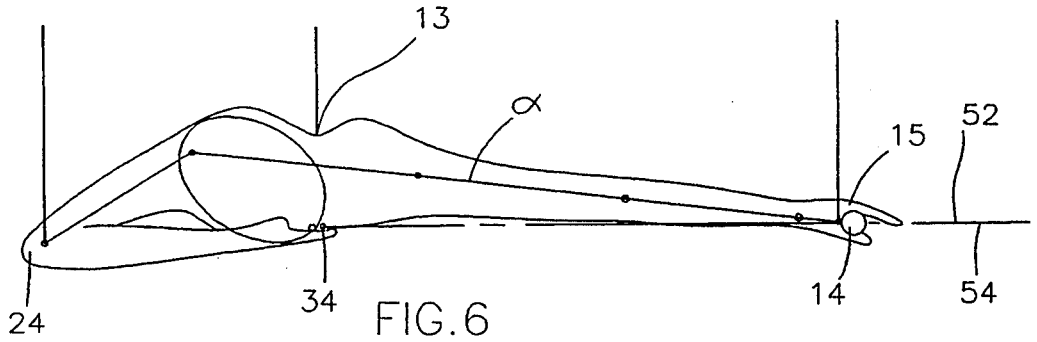
FIG. 6 is a top view of an archer showing the effect of a proper push-pull balance.
Figure 7:
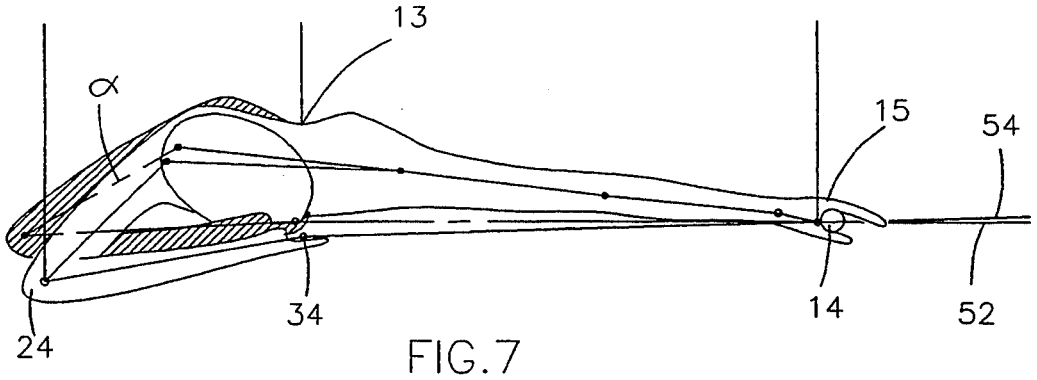
FIG. 7 is a top view of an archer showing the effect of an improper push-pull balance in which the rear half of the archer is providing only a static force opposing the bow force.

FIGS. 6 through 8 illustrate the previously described effect of maintaining the proper push-pull balance between the bow hand 15 and the string arm elbow 24. It is imperative that the pull force of the anchor hand 34 and the push force of the bow hand 15, which define a force line on the rigid frame plane a, are balanced throughout the shot to assure stability and accuracy of the shot. The push and pull of the draw are independent of each other, and are designated to be either "dynamic" or "static". As noted before, a dynamic force means contracting muscles that adapt to remain equal to the opposing bow force during bowstring release, while a static force means contracting muscles that are less than the opposing bow force during bowstring release. In that the dynamic push-pull balance is dependent upon the archer's ability to maintain a muscular force balance between the front and rear halves of his or her stance, a weaker archer is generally more prone to imbalance than a stronger archer.

When balanced, the push-pull effect acts along the previously-noted body relax line 52 throughout the release cycle (unless zero reflex muscle relax time could be achieved, then, the push-pull effect would act along the zero relax line 56) (shown in FIGS. 4 and 5). Each half opposes the bow force with the same dynamic force during the release cycle. However, if each half of the push-pull does not have the same dynamic muscle force when the bowstring is released, the arrow's trajectory will follow the force relax line 54, which differs from the body relax line 52, as illustrated in FIGS. 7 and 8. In each case, the force relax line 54 deviates from the body relax line 52, thereby significantly affecting the arrow's trajectory, which compounds the effect of the reflex muscle relax time that establishes the body relax line 52.

The archery training device 10 shown in FIG. 9 aids an archer in overcoming the above defects by imposing a constant tensional force between the archer's string arm and bow hand that serves to keep the muscles of the back, arms and hands taut before, during and after the shot. As a result, this muscular tension prevents the collapse of the front and rear halves of the archer's stance after the bowstring has been released. In effect, the collapse of the archer's shoulders 23 and 25, as shown in FIGS. 4 and 5, string arm elbow 24, anchor hand 34 and bow hand 15 is prevented after release of the bowstring 16 by forcing the archer 12 to maintain the appropriate push-pull balance throughout the shot. As noted previously, failure to maintain the push-pull balance has as its primary consequence the effect of pulling the arrow grouping to one side or the other of the target, depending upon which half of the archer has collapsed. As a secondary effect, the archer's consistency is adversely affected, as indicated by the inability to shoot a tight arrow grouping. Typically, an archer will unknowingly resort to altering his or her sight to compensate for the push-pull balance error. However, the archer will be unable to compensate for the inconsistency, which is inherent with a partial collapse of the archer's stance in which the archer's string arm elbow 24, shoulders 23 and 25, bow hand 15 and/or anchor hand 34 fall outside of the rigid frame plane $\alpha$.

Figure 11:
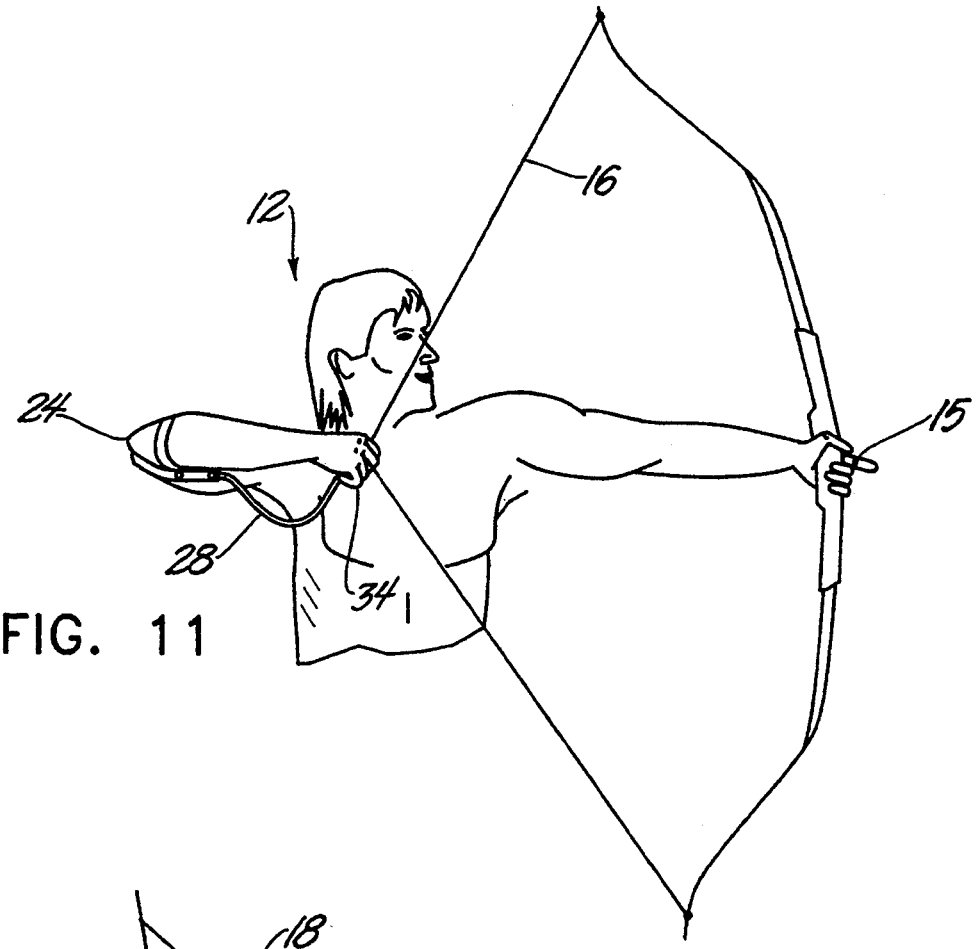
FIG. 11 is a perspective view of an archer using an archery training device constructed in accordance with the preferred embodiment of the present invention, the archery bow being shown in full draw configuration.

With particular reference to FIGS. 9 and 10, the archery training device according to a preferred embodiment of the present invention includes a string arm connector, a bowstring connecting portion 38 and an inelastic cord-like force carrying member interconnecting the string arm connector 18 and the bowstring. The string arm connector 18 includes an upper loop and a lower loop which are securable to the upper arm and forearm, respectively, of the archer's string arm 22 proximate the string arm elbow 24. The upper and lower loops 20 and 26 are preferably formed from an inelastic material which is both strong and durable, such as nylon. The upper and lower loops 20 and 26 are joined together at a first anchor point 29. The fastening method used can be any convenient form which is strong yet lightweight and suitable for mass production, preferably a threaded fastener 60 as best shown in FIG. 9. The fastener 60 also serves as an anchor for the attachment of the inelastic cord-like force carrying member 28 to the string arm connector 18. As best seen in FIG. 11, the loops 20 and 26 together cooperate to straddle the string arm elbow 24 to prevent unwanted shifting of the archery training device 10 about the string arm elbow 24, and thereby promote operational safety.

In the preferred embodiment shown in FIGS. 9 and 10, the upper and lower loops 20 and 26 are also permanently joined at a second anchor point 31 and a third anchor point 33 by a fastener 62. The fastener 62 shown is a grommet. Preferably, the second and third anchor points 31 and 33 are located equidistant from, but on opposite sides of the first anchor point 29. An intermediate elastomeric member extends between the second and third anchor points 31 and 33 so as to reduce the effective size of the upper and lower loops 20 and 26 and to pull the upper and lower loops 20 and 26 toward each other when on the string arm 22. By this construction, the upper and lower loops 20 and 26 can better conform to the archer's upper arm and forearm, thereby further minimizing the likelihood of the string arm connector 18 slipping on the archer's string arm 22.

As noted above, the inelastic cord-like force carrying member 28 is attached to the string arm connector 18 with the fastener 60 and the bowstring connector 38 can be looped around the bowstring to attach to the bowstring. The inelastic cord-like force carrying member 28 is preferably a cord and formed from a highly inelastic material, such as nylon. When properly adjusted for the archer the cord-like force carrying member 28 permits slack to be formed between the string arm connector 18 and the bowstring connector 38 when the archer assumes a full draw position, such as shown in FIG. 11 which illustrates the inelastic cord-like force carrying member in a full draw position. Upon complete release of the bowstring, the inelastic cord-like force carrying member 28 is adjusted prior to use to attain a fully extended or taut position as the fingers completely release the bowstring. Thereafter, the full force of the shot is applied to the inelastic cord-like force carrying member 28 and the string arm connector 18 and in turn to the archer's body to instantaneously transfer the full tensile force of the shot to the archer's entire upper body framework. Forces exerted on the upper body by the inelastic cord-like force carrying member 28 require the archer to push and pull his upper body muscles so that they continue to work throughout the duration of the shot. This minimizes the reflex muscle relax time as defined earlier, and improves both the accuracy and consistency of shooting with repeated practice.

This constant tensional force is sustained as long as the archer's string arm elbow 24 is drawn back in the full draw position shown, which is the situation throughout the shot, from the time the bowstring 16 is fully drawn until the arrow clears the bowstring 16. Accordingly, there is an instantaneous tensional force between the string arm elbow 24 and the bow hand 15 upon complete release of the bowstring 16 to maintain the archer 12 in a stance that requires constant muscular tension that sustains the push-pull balance of FIG. 6.

The instantaneous tensional force imposed by the inelastic cord-like force carrying member 28 causes a pulling force upon the muscles associated with the upper back which position the archer's anchor hand 34, bow hand 15, string arm elbow 24, and shoulders 23 and 25. It is this instantaneous tensional force associated with the taut configuration of the archery training device 10 which exercises these muscles to maintain a memory position so as to maintain the dynamic push-pull balance while also minimizing movement and muscle relaxation during release of the bowstring 16. As a result, the upper back muscles are trained through muscle memory to maintain the proper push-pull balance and shorten the reflex muscle relax time by inhibiting collapse of the upper back muscles, shoulders 23 and 25 and string arm elbow 24. Muscle memory induced by sufficient practice with the archery training device 10 enables the archer to later shoot with the proper push-pull balance and a shortened reflex muscle relax time without the archery training device 10.

As stated above, an actual arrow may be used with the training device. The arrow is properly mounted to the bow and bowstring as if an actual shot will be made to a target. The training device is attached to the bowstring as disclosed above. The archer will withdraw the bowstring and arrow and assume a full draw position resulting in the inelastic cord-like force carrying member 28 assuming a slack position as shown in FIG. 11. If a draw clicker is used, the archer may release the bowstring upon hearing the "click" of the draw clicker or, in the alternative, the bow may be dry fired after assuming the full draw position which results in the inelastic cord-like force carrying member 28 becoming fully extended after complete bowstring release to permit the muscles to exercise as disclosed above. Naturally, as the bowstring only travels forward a sufficient amount to clear the fingers until the inelastic cord-like force carrying member 28 is fully extended, the arrow actually shot travels only a few feet from the archer. However, actual shooting conditions are experienced by the archer through the use of the training device.

By repeated use of the archery training device 10 of any of the above embodiments and particularly the preferred embodiment of FIGS. 9 an 10, the archer is aided in his or her attempt to attain proper muscle training to obtain a perfect shot. The perfect shot is characterized by coplanar movement of the points A through C (FIGS. 1 through 3) from the beginning of bowstring release to the point at which the arrow clears the bow 14 and the bow force is dissipated. The inelastic cord-like force carrying member 28 sustains constant tensional forces upon the string arm elbow 24 and the bow hand 15 throughout bowstring release and after the shot, thereby requiring the archer 12 to maintain proper muscular control, muscle force and body positioning before, during, and after bowstring release. More specifically, the archery training device 10 of the present invention promotes the dynamic push-pull balance between the string arm elbow 24 and the bow hand 15 while also providing feedback of this balance when actually shooting arrows. Simultaneously, the archery training device 10 also reduces the effects of the reflex muscle relax time and promotes proper positioning of the anchor hand 34, bow hand 15, string arm elbow 24, and shoulders 23 and 25 of the archer within the rigid frame plane $\alpha$ when he or she is drawing and releasing the bowstring. The archery training device 10 achieves the above aspects while also permitting the archer 12 to shoot an arrow to allow the placement of the arrow to serve as a distinct form of feedback as to his or her push-pull balance and stance. Thus, repeated practice with the archery training device 10 teaches the archer proper upper body rear muscular control and body positioning for accurate shooting in a manner that was not heretofore possible.

In operation, the archer 12 places the string arm connector 18 upon his or her string arm 22 to straddle the string arm elbow 24 after attaching the bowstring connector 38 to the bowstring. In the preferred embodiment of FIG. 9, the length of the inelastic cord-like force carrying member 28 is adjusted to produce a slack condition when the archer 12 is in a full draw position, as seen in FIG. 11. More preferably, the length of the inelastic cord-like force carrying member 28 is such that a full tensional force is imposed upon both the string arm elbow 24 and the bow hand 15 instantaneously when the archer 12 has released the bowstring upon shooting an arrow.

Figure 12:
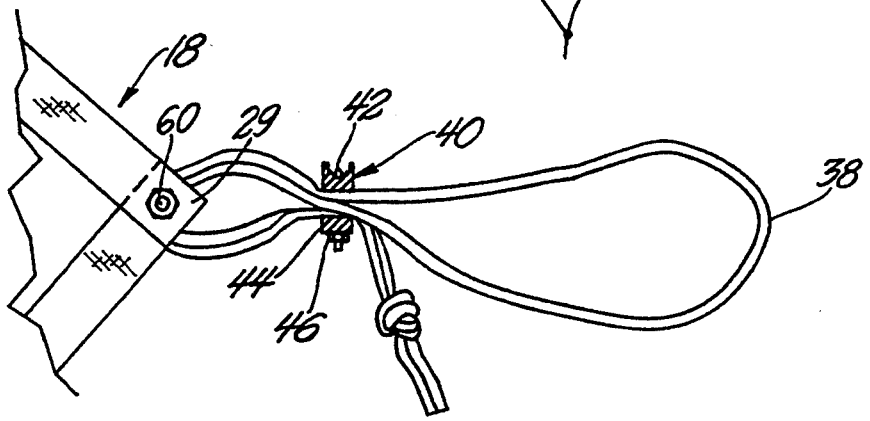
FIG. 12 illustrates the archery training device according to the preferred embodiment of the invention utilizing a variant adjuster.
Figure 13:
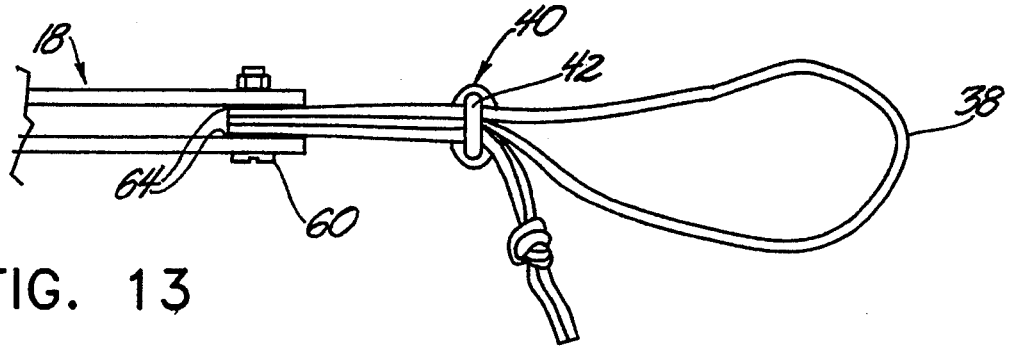
FIG. 13 is a top view of the adjuster embodiment shown in FIG. 12.

FIGS. 12 and 13 are alternative embodiments for adjusting the force carrying member for the specific archer shooting the bow. As illustrated in FIG. 12, the inelastic cord-like force carrying member 28 has an adjuster 40 that permits adjustment of its length to ensure that the inelastic cord-like force carrying member 28 has a predetermined slack when in a full draw position. The adjuster is a U-shaped clamp member 42 with a bar clamp member 44 that extends between the legs of the U-shaped clamp member to capture the looped portion of the inelastic cord-like force carrying member 28 adjacent the first anchor point. A pair of nuts 46 secure the bar clamp member to the threaded ends of the legs of the U-shaped clamp member 42 to tightly grip the inelastic cord-like force carrying member after appropriate adjustment to provide the predetermined slack between the bowstring connecting portion and the first anchor point when the archer attains a full draw position.

FIGS. 9 and 10 illustrate the preferred embodiment for the adjustment of the inelastic cord-like force carrying member 28. In the preferred embodiment, an elastic retention member 48 is slipped over the cord-like force carrying member and positioned near the first anchor point 29 to capture the looped portion of the inelastic cord-like force carrying member 28 after appropriate adjustment is made to provide the predetermined slack between the bowstring connector portion 38 and the first anchor point 29 for the inelastic cord-like force carrying member. The elastic retention member 48 as well as the threaded fastener 60 provide sufficient tension on the inelastic cord-like force carrying member 28 to prevent any slippage around the first anchor point 29. To promote the retention of the inelastic cord-like force carrying member at the first anchor point 29, a pair of washers 64 are provided at the first anchor point to clamp the inelastic cord-like force carrying member 28 after it is wrapped about the fastener 60.

The archer 12 then fully draws the bow 14 to the full draw position (FIG. 11) with the arrow which places the inelastic cord-like force carrying member 28 in a slack position. When the archer 12 has correctly aimed the arrow at the target, he or she releases the bowstring 16 to shoot the arrow. After release, the inelastic cord-like force carrying member 28 is fully extended and the full draw forces are instantaneously transferred to the entire upper body framework to avoid reflex muscle relax time as defined earlier and to maintain the distinct feedback as to the dynamic push-pull conditions between the string arm elbow 24 and the bow hand 15 and thereby maintain the rigid frame plane $\alpha$ throughout the entire shot.

As noted previously, a significant advantage to the use of the archery training device 10 of the present invention is that the constant force generated by the inelastic cord-like force carrying member is instantaneously transferred to the string arm 22, the string arm elbow 24, the anchor hand 34, the bow hand 15, the shoulders 23 and 25, and the remaining parts of the entire upper body framework. The force exerted on the upper body by the inelastic cord-like force carrying member 28 is constant between the full draw position and the released position, requiring the archer 12 to push and pull his upper body muscles so that they work throughout the duration of the shot. This not only necessitates that the archer 12 maintain a proper push-pull balance throughout the shot, but also minimizes the reflex muscle relax time as defined earlier, which together improve both the accuracy and consistency of shooting with repeated practice.

In addition, in the preferred embodiment the nature of the inelastic cord-like force carrying member 28 specifically provides ample length between the string arm connector 18 and the bowstring connector 38 so as not to interfere with the draw of the bowstring 16. Accordingly, the full draw position of the archer 12 is not limited by the length of a cord-like force carrying member, as is taught in the prior art.

While the invention has been described in terms of a preferred embodiment, it is apparent that other forms could be adopted by one skilled in the art. For example, variations in the manner in which the string arm connector 18 is designed to straddle the string arm elbow 24 could be made. Additionally, other means for creating a tensional force, either lateral or in line, upon the string arm elbow 24 and bow hand 15 could be adopted by those skilled in the art to achieve the muscular positioning and force balance as described. Accordingly, the scope of the invention is to be limited only by the following claims.

What is claimed is:

1. An archery training device for teaching an archer proper upper body muscular control and body positioning of the archer's back, shoulders, string arm, bow arm and bow hand along a rigid plane, said muscular control providing a push-pull balance that prevents collapse of said string arm and bow arm during and after release of a bowstring, said archery training device comprising:

a string arm connector having an upper securing means and a lower securing means, said upper securing means being securable to an upper arm portion of said string arm, said lower securing means being securable to a forearm portion of said string arm, said upper securing means and said lower securing means together cooperating to prevent shifting of said string arm connector upon said string arm;

an inelastic draw force carrying member having:

one end attached to said string arm connector;

an opposite end extending in a direction away from said string arm connector;

first means for attaching said one end of said draw force carrying member to said string arm connector; and second means for attaching said opposite end of said draw force carrying member to said bowstring such that when said archery training device is mounted to said upper portion of said archer's string arm by said upper securing means and said lower portion of said string arm by said lower securing means and said opposite end of said draw force carrying member is attached to said bowstring and said bowstring is drawn to the full draw position, said first and second attaching means establishes a predetermined slack in said draw force carrying member to avoid any external forces other than said bowstring draw force to be applied to said archer's back, shoulders, string arm, bow arm, or bow hand while in said full draw position and whereby further after the bow string fingers release said bowstring and said archer experiences a complete release of said bowstring, the muscles associated with said upper body instantaneously experience the forces associated with said full draw position by said draw force carrying member instantaneously extending to a predetermined fixed length position so that the muscles associated with said upper body continue to work after release of said bowstring to maintain said muscular control of said archer's back, shoulders, string arm, bow arm and bow hand along said rigid frame plane and to maintain said push-pull balance, said push-pull balance preventing collapse of said string arm and bow arm after normal release of said bowstring, said collapse otherwise affecting said archer's ability to accurately shoot an arrow with a bow.

2. The archery training device of claim 1 wherein said upper securing means is an upper loop and said lower securing means is a lower loop in said string arm connector.

3. The archery training device of claim 1 wherein said upper securing means and said lower securing means are both secured adjacent the elbow of said string arm.

4. The archery training device of claim 1 wherein said upper securing means and said lower securing means are joined at a slip loop, said slip loop being slidably adjustable upon said string arm connector to provide adjustment of said string arm connector upon said string arm.

5. The archery training device of claim 1 further comprising adjustment means at said string arm connector for adjusting the length of said draw force carrying member.

6. The archery training device of claim 1 wherein said first means for attaching said one end comprises a first adjuster for adjusting the distance between said first and second attaching means.

7. The archery training device of claim 6 wherein said draw force carrying member has a cord-like draw force carrying member construction, and said first adjuster connects said cord-like draw force carrying member to said string arm connector that defines said upper and lower securing means.

8. The archery training device of claim 6 wherein said first adjuster comprises a U clamp.

9. The archery training device of claim 7 wherein said first adjuster comprises a U clamp,

10. The archery training device of claim 7 wherein said first means for attaching includes a first anchor point connector.

11. The archery training device of claim 10 wherein said first anchor point connector comprises a bolt and nut.

* * * * *

UNITED STATES PATENT AND TRADEMARK OFFICE

CERTIFICATE OF CORRECTION

PATENT NO. : 5,353,780
DATED : October 11, 1994
INVENTOR(S) : Richard F. Carella It is certified that error appears in the above-indentified patent and that said Letters Patent is hereby corrected as shown below:

Column 2, line 48, delete "a" insert ---- α ----.

Column 8, line 44, delete "a" isnert ---- α ----.

Column 11, line 19, delete "an" insert ---- and ----.

Signed and Sealed this

Sixth Day of December, 1994

*Attest:*

Bruce Lehman

BRUCE LEHMAN

*Attesting Officer*

*Commissioner of Patents and Trademarks*